US010539898B2

(12) United States Patent
Deprez et al.

(10) Patent No.: US 10,539,898 B2
(45) Date of Patent: Jan. 21, 2020

(54) RADIATION CURABLE DRY TONER AND METHOD FOR PREPARING THE SAME

(71) Applicant: Xeikon Manufacturing N.V., Lier (BE)

(72) Inventors: Lode Erik Dries Deprez, Wachtebeke (BE); Werner Jozef Johan Op de Beeck, Putte (BE)

(73) Assignee: Xeikon Manufacturing N.V., Lier (BE)

( * ) Notice: Subject to any disclaimer, the term of this patent is extended or adjusted under 35 U.S.C. 154(b) by 0 days.

(21) Appl. No.: 16/096,048

(22) PCT Filed: Apr. 25, 2017

(86) PCT No.: PCT/EP2017/059697

§ 371 (c)(1),
(2) Date: Oct. 24, 2018

(87) PCT Pub. No.: WO2017/186657

PCT Pub. Date: Nov. 2, 2017

(65) Prior Publication Data

US 2019/0129322 A1 May 2, 2019

(30) Foreign Application Priority Data

Apr. 25, 2016 (NL) ..... 2016672

(51) Int. Cl.
*G03G 9/093* (2006.01)
*G03G 9/08* (2006.01)

(52) U.S. Cl.
CPC ..... *G03G 9/09371* (2013.01); *G03G 9/0819* (2013.01); *G03G 9/0821* (2013.01);
(Continued)

(58) Field of Classification Search
CPC ..... G03G 9/09371; G03G 9/09392; G03G 9/09357; G03G 9/0819; G03G 9/09314;
(Continued)

(56) References Cited

U.S. PATENT DOCUMENTS 5,395,926 A 3/1995 Tavernier et al.
5,470,683 A 11/1995 Inaishi
(Continued)

FOREIGN PATENT DOCUMENTS

EP 0601235 B1 9/1995
EP 0667381 B1 1/2000
(Continued)

OTHER PUBLICATIONS

Ding et al., "A Process for the Manufacture of Chemically Produced Toner (CPT). I. Evolution of Structure and Rheology", 2005, Ind. Eng. Chem. Res., vol. 44, pp. 6004-6011.

*Primary Examiner* — Thorl Chea
(74) *Attorney, Agent, or Firm* — The Webb Law Firm

(57) ABSTRACT

A radiation curable dry toner includes core-shell toner particles. The core-shell toner particles have an average volume-based diameter between 5 and 10 micrometre, and a core-shell toner particle thereof includes an inner portion having a radiation curable first resin material consisting of at least 90 weight %, preferably at least 95 weight %, of the total amount of resin material of the inner portion; an outer shell surrounding said inner portion, said outer shell including a second resin material, said second resin material being any one of the following: cured first resin material; or a resin material which is different from the first resin material.

21 Claims, 3 Drawing Sheets

(52) U.S. Cl.
CPC ..... *G03G 9/0825* (2013.01); *G03G 9/09314* (2013.01); *G03G 9/09328* (2013.01); *G03G 9/09357* (2013.01); *G03G 9/09392* (2013.01)

(58) Field of Classification Search
CPC . G03G 9/0825; G03G 9/0821; G03G 9/09328
See application file for complete search history.

(56) References Cited

U.S. PATENT DOCUMENTS

| | | | | |
|---|---|---|---|---|
| 5,905,012 | A * | 5/1999 | De Meutter ..... | G03G 9/08793 430/108.1 |
| 7,901,860 | B2 | 3/2011 | Deprez et al. | |
| 8,455,166 | B2 | 6/2013 | Op De Beeck et al. | |
| 2010/0068478 | A1 * | 3/2010 | Humpert ..... | G03G 9/12 428/195.1 |
| 2010/0285401 | A1 | 11/2010 | Sacripante et al. | |
| 2011/0217645 | A1 | 9/2011 | Zhou et al. | |
| 2011/0318685 | A1 | 12/2011 | Vanbesien et al. | |

FOREIGN PATENT DOCUMENTS

| | | | |
|---|---|---|---|
| EP | 1930780 | B1 | 2/2010 |
| EP | 1756675 | B1 | 4/2010 |
| EP | 2249211 | A1 | 11/2010 |
| EP | 2019340 | B1 | 9/2012 |
| EP | 2031452 | B1 | 10/2017 |

* cited by examiner

RADIATION CURABLE DRY TONER AND METHOD FOR PREPARING THE SAME

CROSS-REFERENCE TO RELATED APPLICATIONS

This application is the United States national phase of International Application No. PCT/EP2017/059697 filed Apr. 25, 2017, and claims priority to Dutch Patent Application No. 2016672 filed Apr. 25, 2016, the disclosures of which are hereby incorporated in their entirety by reference.

FIELD OF INVENTION

The field of the invention relates to the field of radiation curable dry toners. Particular embodiments relate to a method for preparing radiation curable dry toner, to a radiation curable dry toner, and to a dry electrostatic developer comprising such a radiation curable dry toner.

BACKGROUND

In imaging methods like electro(photo)graphy, magnetography, ionography, etc. a latent image is formed which is developed by attraction of so called toner particles. Afterwards the developed latent image is transferred to a substrate and fused on this substrate. In such methods dry radiation curable toner particles may be used. Dry toner particles are basically polymeric particles comprising a polymeric resin as a main component and various ingredients mixed with said toner resin. Apart from colourless toners, which are used e.g. for finishing function, the toner particles comprise at least one black and/or colouring substance, e.g., coloured pigment. Examples of such dry toners are described in European patents EP 1 756 675 B1, EP 1 930 780 B1, and EP 2 019 340 B1 in the name of the Applicant, which are included herein by reference.

To obtain a good curing efficiency the toner has to be brought in a low viscous state so that the mobility of the reactive groups (e.g. double bounds) is high and the right degree of crosslinking can be achieved using e.g. UV curing or electron beam curing. As the viscosity of the toner (at fusing temperature) is linked to the glass transition temperature (Tg), this means that the glass transition temperature should not be too high. This applies in particular for substrates with a dimensional stability which decreases at higher temperatures, such as thin polyethylene or thin polypropylene substrates. Using low viscosity toners has however some major drawbacks.

A first drawback is that the use of a low viscosity toner causes limitations with respect to storage conditions and an increased risk for the formation of toner aggregates or lumps in the developing unit during the toner carrier mixing. Under normal transport conditions, the temperature may be high, resulting in sintering of the low viscosity toners. To prevent sintering, the low viscosity toners may be transported under special conditions, but this increases the transport cost. Therefore, preferably prior art toners have a Tg which is typically larger than 50° C.

A second drawback is that during the mixing of toner and carrier in the developing unit the surface additives used to control the charge and toner flow characteristics will be easily embedded. This change in toner surface state changes the charging and flowing properties of the toner meaning that no stable charge over time and under different page coverage can be established. Another effect of embedded surface additives is that the develop ability decreases by a stronger interaction between the toner surface (typically a polymer surface) and carrier so that the adhesion forces increase and it is more difficult to develop the toner onto the photoconductor for the same development potential and to transfer the toner from the photoconductor to the substrate. This effect will be even more pronounced in high speed printing, i.e. at speeds higher than 0.3 m/s. Those problems can be overcome by applying high amounts of surface additives on the toner surface. This however will reduce the ability to fuse and as a consequence cure the toner in a proper way, because it is typically desirable that the toner particles first lose their corpuscular behaviour and form a continuous film prior to performing the crosslinking.

Another reason why most of the toners that are used in the field have a high Tg (and thus a high melt viscosity) is the storage stability of the printed material. Printed substrate material put into a car which is in full sunlight for some hours can reach temperatures of 80° C. If the Tg is too low the toner remelts at those elevated temperatures, and layers of the printed substrate material may stick to each other. Some storage stability problems after printing can be overcome by applying a varnish or lacquer but this is not always possible (e.g. office materials or books) and adds costs and complexity to the printing process.

At least for those reasons, many prior art toners have a higher Tg. However, for such toners, the amount of energy necessary to fuse the toner particle onto the substrate increases, making the use thereof energetically less interesting. Also, when using a higher Tg, a lot of substrates cannot be used anymore because of the limited substrate dimensional stability at higher fusing temperatures.

Taking into account the above, printer manufacturers are looking for a good balance between storage stability of the toner before printing, stable toner properties during the printing process, energy efficient printing, and storage stability of the printed substrates after printing

SUMMARY

The object of embodiments of the invention is to provide a radiation curable dry toner which can be transported under normal transport conditions and allows for energetically efficient printing on various types of substrates; and a method for preparing such a radiation dry curable toner.

According to a first aspect of the invention there is provided a radiation curable dry toner comprising core-shell toner particles. A core-shell toner particle thereof comprises an inner portion and an outer shell surrounding said inner portion. The core-shell toner particles have an average volume-based diameter between 5 and 10 micrometre. The inner portion comprises a radiation curable first resin material consisting of at least 90 weight %, preferably at least 95 weight %, of the total amount of resin material of the inner portion. The outer shell comprises a second resin material. The second resin material is one of: cured first resin material; or a resin material which is different from the first resin material.

By providing core-shell toner particles with an outer shell which includes a second resin material which is different from the first resin material, or with an outer shell which includes cured first resin material, the storage stability can be significantly improved. Indeed, when the toner particles are prepared chemically in the preparing step, an appropriate second resin material can be chosen for the outer shell, to improve the storage stability whilst the first resin material can be chosen to give the toner suitable printing properties, such as a suitable melt viscosity. In other embodiments, where the toner particles may be prepared mechanically or chemically in the preparing step, an outer shell thereof may be cured, improving the storage stability. Further, by including at least 90 weight % of curable first resin material a good curing efficiency can be obtained.

Preferably the first resin material (and optionally also the second resin material, if different from the first resin material) is chosen such that the dry toner has a melt viscosity of less than 1000 Pa·s, more preferably less than 850 Pa·s and most preferably less than 700 Pa·s at 120° C., measured at a frequency of 1 Hz and an amplitude of 0.005 radians. Preferably, the first resin material has a melt viscosity of less than 950 Pa·s, more preferably less than 850 Pa·s and most preferably less than 700 Pa·s at 120° C., measured at a frequency of 1 Hz and an amplitude of 0.005 radians. The melt viscosity of the second resin material is preferably higher than the melt viscosity of the first resin material, but such that the resulting dry toner has a melt viscosity of less than 1000 Pa·s, more preferably less than 850 Pa·s and most preferably less than 700 Pa·s at 120° C., measured at a frequency of 1 Hz and an amplitude of 0.005 radians.

Preferably the dry toner has a storage stability of at maximum 100 g/kg, preferably at maximum 50 g/kg; wherein the storage stability is determined by shaking 20 g of the dry toner in a 50 ml bottle, followed by conditioning the dry toner for 40 hours at 40° C., whereupon the dry toner is manually sieved over a 300 μm sieve and the amount of toner remaining on the sieve is weighed and expressed as g/kg toner versus the original amount of 20 g.

In an exemplary embodiment the first resin material has a first glass transition temperature, and the second resin material has a second glass transition temperature, and the difference between the second glass transition temperature and the first glass transition temperature is smaller than 25° C., preferably smaller than 23° C., more preferably smaller than 20° C. By limiting this temperature difference it is avoided that coalescing problems arise during fusing after transfer of the image on the substrate.

Preferably, the difference between the second glass transition temperature and the first glass transition temperature is larger than 5° C., more preferably larger than 10° C. These preferred values for the difference apply in particular when the second resin is an uncured resin which is different from the first resin.

Preferably, the first glass transition temperature is between 20 and 60° C., preferably between 25 and 50° C., and more preferably between 30 and 50° C. By having a sufficiently high first glass transition temperature, the strength of the particles, and in particular the mechanical impact resistance is increased. Especially for dual component developer containing dry toner particles and carrier particles in contact with each other, this is advantageous.

Such preferred embodiments are based inter alia on the inventive insight that by providing the toner particles with an outer shell comprising a second resin material having a second glass transition temperature which is higher than a first glass transition temperature of curable first resin material of the inner portion, an improved transportability under normal transport conditions is achieved. At the same time the curable first resin material can have a low glass transition temperature, resulting in a reduced toner melt viscosity, such that fusing and curing the toner on the substrate can be performed with a reduced amount of energy compared to prior art toners having a high glass transition temperature, especially when roller fusing is used. Although the outer shell will still require somewhat more energy in order to be fused, the total amount of energy needed will be significantly lower, especially in view of the fact that at least 90 weight % of the first resin material of the inner portion is curable resin material with a relatively low glass transition temperature.

A further advantage of the higher glass transition temperature of the outer shell is that any surface additives will have a decreased tendency to be embedded during the mixing of dry toner and carrier in the developing unit, so that the above mentioned problems related to the embedding of additives are at least partially solved.

In an exemplary embodiment the outer shell comprises cured resin material. Such an embodiment has the advantage that the outer shell may be formed by curing. For example, toner particles comprising radiation curable resin material may be dispersed, and an outer shell thereof may be heated, cured, and then cooled, so that core-shell toner particles are formed with an inner portion comprising uncured radiation curable resin material and an outer shell comprising cured resin material.

In alternative embodiments, especially where the dry toner is prepared chemically, the second resin material of the outer shell may be different from the curable first resin material of the inner portion. For example, the radiation curable first resin material may be a UV curable resin material comprising a photo-initiator, and the second resin material may be a curable resin material with a thermal initiator which has been cured or an uncured resin material with a higher melting point or with a higher melt viscosity compared to the first resin material.

The core-shell toner particles have an average volume-based diameter between 5 and 10 micrometre. A volume-based particle diameter equals the diameter of the sphere that has the same volume as the given particle. It is preferred that the particle size distribution is characterised by a coefficient of variability smaller than 0.5. The outer shell may have an average thickness below 500 nanometre, preferably between 20 and 400 nanometre, more preferably between 40 and 350 nanometre, and most preferably between 50 and 300 nanometre. Such thicknesses result in stable particles whilst limiting the volume percentage of the outer shell with respect to the total volume of the core-shell toner particle so that the impact of the outer shell on the fusing and curing on the substrate is limited.

In an exemplary embodiment the radiation curable resin material of the inner portion has a milli-equivalent amount of double bounds per gram of said radiation curable resin material which is more than 0.5 meq/g, more preferably more than 0.7 meq/g.

In an exemplary embodiment the radiation curable first resin material comprises a photo-initiator.

In an exemplary embodiment the second resin material is a non-radiation curable resin material having the second glass transition temperature. Such embodiments may be prepared chemically, e.g. by aggregating an outer shell comprising the non-radiation curable second resin material around an inner portion comprising radiation curable first resin material. The second resin material is chosen to be chemically compatible with the first resin material, in the sense that the second resin material of the outer shell should adhere to the first resin material of the inner portion.

According to another aspect there is provided a method for preparing a radiation curable dry toner comprising core-shell toner particles, said method comprising:

a. preparing dry toner particles comprising a radiation curable resin material; said radiation curable resin material preferably consisting of at least 90 weight %, more preferably at least 95 weight %, of the total amount of resin material of the prepared particles;

b. dispersing and heating said toner particles in a fluid flow;

c. curing an outer shell of said toner particles in said fluid flow;

d. cooling said toner particles in order to obtain the core-shell toner particles.

Preferably, the dry toner particles are prepared with dimensions which are such that the obtained core-shell toner particles have an average volume-based diameter between 5 and 10 micrometre.

Embodiments of this aspect are based on the inventive insight that by curing an outer shell of the prepared toner particles, the glass transition temperature of the outer shell can be increased, resulting in an improved transportability under normal transport conditions. At the same time the unmodified inner portion of the toner particles can have a low glass transition temperature, such that the overall toner melt viscosity is lower compared to traditional toner having a higher glass transition temperature in the entire particle. In this way fusing and curing the toner on the substrate can be performed with a reduced amount of energy.

Preferably, the heating comprises bringing the outer shell at a temperature above the glass transition temperature of the curable resin material. Since only the outer shell is brought at a temperature above the glass transition temperature, the inner portion can be refrained from crosslinking because the mobility of the crosslinking groups is too low.

Preferably the fluid flow in which the toner particles are carried is an airflow. Typically the particles will be dispersed first in a cold airflow, and once dispersed a hot airflow is added to the cold airflow to heat an outer shell of the particles.

In an exemplary embodiment, the preparing of the dry toner particles in step (a) comprises including a thermal initiator in at least the outer shell of the toner particles; and wherein said curing comprises heating the dispersed toner particles in the fluid flow such that the thermal initiator in the outer shell is activated to cause the curing of the outer shell. In other words, the curing may then consist in heating the toner particles without radiating the toner particles.

In an exemplary embodiment, the preparing of the dry toner particles in step (a) comprises including a photo-initiator in at least an outer shell of the toner particles; and the curing comprises heating and irradiating the dispersed toner particles in the fluid flow with actinic radiation such that the photo-initiator in the outer shell is activated to cause the curing of the outer shell. It is noted that the entire particle may contain a photo-initiator. This will typically be the case for UV curable dry toners. Also the entire particle may contain a first type of photo-initiator, wherein a second type of photo-initiator is added to the outer shell. In other embodiments no photo-initiator may be provided in the inner portion, and only the outer shell may contain a photo-initiator. This may be the case for particle beam curable toner particles which may be cured during printing by a particle beam, e.g. by electron beam curing, without the need for a photo-initiator in the inner portion of the particles.

In an exemplary embodiment, the preparing of the dry toner particles in step (a) comprises: melt kneading ingredients comprising colouring agent and radiation curable compounds to obtain a mixture; cooling said mixture; and milling said cooled mixture to obtain dry toner particles.

In an exemplary embodiment, the radiation curable resin material has a glass transition temperature between 20 and 60° C., preferably between 25 and 50° C., and more preferably between 30 and 50° C.

In an exemplary embodiment, the curing is controlled such that the outer shell has an average thickness below 500 nanometre, preferably between 20 and 400 nanometre, more preferably between 40 and 350 nanometre, and most preferably between 50 and 300 nanometre.

In an exemplary embodiment, the radiation curable material is a UV curable material comprising a photo-initiator.

In an exemplary embodiment the toner particles are pulverized toner particles and the temperature is controlled so that only an outer shell of the toner particles is brought in a state allowing curing. When the prepared toner particles have an average circularity well below 1, this temperature control can be easily verified since the resulting increased shape factor of the resulting core-shell toner particles will be an indication of the temperature of the heated outer shell during curing. Preferably the resulting core-shell toner particles have an FPIA average circularity of at least 0.95, and more preferably between 0.96 and 0.98. The FPIA average circularity has been defined and is discussed in detail in EP 2 031 452 which is included herein by reference.

Preferably, the temperature is controlled such that the thickness of the outer shell is below 500 nanometre, preferably between 20 and 400 nanometre, more preferably between 40 and 350 nanometre, and most preferably between 50 and 300 nanometre.

In an exemplary embodiment the outer shell may be brought at a temperature above the glass transition temperature of the curable resin material by heating the toner particles in the fluid flow before the toner particles are subjected to radiation. In another embodiment the heating and the radiating of the toner particles may be performed simultaneously.

According to another aspect of the invention there is provided a radiation curable dry toner comprising core-shell toner particles. A core-shell toner particle thereof comprises an inner portion comprising uncured radiation curable resin material; and an outer shell surrounding said inner portion, said outer shell comprising a cured portion of radiation curable resin material. The term "cured portion" refers to a portion that is at least partially cured such that it has a higher glass transition temperature than the glass transition temperature of the uncured radiation curable material of the inner portion. The term "curing" refers to chemically modifying the radiation curable polymer material such that the material is hardened by cross-linking of polymer chains and the glass transition temperature is increased. The glass transition temperature of the inner portion may be below 60° C., preferably below 50° C., and more preferably between 30 and 50° C. The core-shell toner particles may have an average volume-based diameter between 3 and 20 micrometre, preferably between 4 and 15 micrometre, most preferably between 5 and 10 micrometre. The outer shell may have an average thickness below 500 nanometre, preferably between 20 and 400 nanometre, more preferably between 40 and 350 nanometre, and most preferably between 50 and 300 nanometre.

According to yet another aspect of the invention there is provided a method for preparing a radiation curable dry toner comprising core-shell toner particles, said method comprising:

a. preparing an emulsion including particles comprising a radiation curable first resin material; said radiation curable first resin material consisting of at least 90 weight %, preferably at least 95 weight %, of the total amount of resin material of the prepared particles;

b. aggregating said particles to form aggregated particles;

c. contacting said aggregated particles with a second resin material to form an outer shell over said aggregated particles; said second resin material being different from said first resin material;

d. coalescing the aggregated particles with the outer shell to form core-shell toner particles;

The steps a-d are performed such that the formed core-shell toner particles have an average volume-based diameter between 5 and 10 micrometre.

In other words, an embodiment of the dry toner of the invention may also be made using an emulsion-aggregation process. Examples of suitable emulsion-aggregation processes are described in P. Ding et al., "A Process for the Manufacture of Chemically Produced Toner (CPT). I. Evolution of Structure and Rheology", Ind. Eng. Chem. Res. 2005, 44, pages 6004-6011, which is included herein by reference.

Preferably the first resin material has a melt viscosity of less than 950 Pa·s, more preferably less than 850 Pa·s and most preferably less than 700 Pa·s at 120° C., measured at a frequency of 1 Hz and an amplitude of 0.005 radians. In that way, the melt viscosity of the core-shell toner may also be sufficiently low, whilst the choice of the second resin material may be such that a good storage stability is obtained. Preferably, the first and second resin material are chosen such that the dry toner has a storage stability of at maximum 100 g/kg, preferably at maximum 50 g/kg; wherein the storage stability is determined by shaking 20 g of the dry toner in a 50 ml bottle, followed by conditioning the dry toner for 40 hours at 40° C., whereupon the dry toner is manually sieved over a 300 μm sieve and the amount of toner remaining on the sieve is weighed and expressed as g/kg toner versus the original amount of 20 g.

In a preferred embodiment, the first resin material has a first glass transition temperature, and the second resin material has a second glass transition temperature, and the first and second resin material are chosen such that the difference between the second glass transition temperature and the first glass transition temperature is smaller than 25° C., preferably smaller than 23° C., more preferably smaller than 20° C., but higher than 5° C.

In an exemplary embodiment the step (c) above is controlled such that the outer shell has an average thickness below 500 nanometre, preferably between 20 and 400 nanometre, more preferably between 40 and 350 nanometre, and most preferably between 50 and 300 nanometre.

According to another aspect of the invention there is provided a dry electrostatic developer comprising carrier particles, and a radiation curable dry toner prepared according to the method of any one of the embodiments above or a radiation curable dry toner of any one of the aspects above. The carrier particles may have an average volume-based diameter of 30 to 65 micrometre. The carrier particles may comprise a core portion coated with a resin in an amount of 0.4 to 2.5% by weight, and the absolute charge per particle diameter (Q/D) expressed as fC per 10 micrometre may be between 3 and 13 fC/10 μm.

The radiation curable resin material is composed of one or more radiation curable resins. The radiation curable resin material is preferably a UV-light curable resin material, but may also be another radiation curable resin material, e.g. an electron-beam curable resin material. The radiation curable resin material may be a mixture of one or more radiation curable resins. Further, the radiation curable resin material may be mixed with a non-radiation curable resin material comprising one or more non-radiation curable resins. In that case, the weight percent of radiation curable resin material with respect to the total amount of resin material (i.e. the sum of the radiation curable resin material and non-radiation curable resin material) is preferably higher than 90 weight %, more preferably higher than 95 weight %, and most preferably more than 98 weight %. Useful UV curable resins are resins based on (meth)acryloyl containing polyester. The term polyester includes all polymers with a backbone structure based on a polycondensation of an alcohol, preferably one or more polyols having 2 to 5 hydroxyl groups, and a carboxylic acid-containing compound. Examples of such UV curable resins are unsaturated polyesters based on terephthalic and/or isophthalic acid as the carboxylic acid-containing component, and on neopentylglycol and/or trimethylolpropane as the polyol component and whereon afterwards an epoxy-acrylate such as glycidyl (meth)acrylate may be attached. Another UV curable resin is a polyester-urethane acrylate polymer which may be obtained by the reaction of a hydroxyl-containing polyester, a polyisocyanate and a hydroxy-acrylate. Another useful curable resin material is composed of a mixture of an unsaturated polyester resin in which maleic acid or fumaric acid is incorporated and a polyurethane containing a vinyl ether. If a non-radiation curable resin material is included, the weight percentage of the non-radiation curable resin material is preferably less than 5 weight % of the total resin amount. The non-radiation curable resin material may contain one or more of the following resins: poly condensation polymers (e.g. polyesters, polyamides, co(polyester/polyamides), etc), epoxy resins, addition polymers.

For example, the radiation curable resin material may be a resin material comprising a blend of a (meth)acrylated polyester resin and a meth(acrylated) polyurethane resin. Preferably, the milli-equivalent amount of double bounds per gram of said radiation curable resin is more than 0.5 meq/g, more preferably more than 0.7 meq/g.

In addition to the radiation curable material, the prepared toner particles may comprise any one or more of the following: a colouring agent, a photo-initiator, a wax, a thermal initiator, a flowability improving agent, a charging agent, etc.

In the present invention, the term "radiation curable" refers to curable by actinic radiation or by a particle beam. The term "actinic radiation" is understood to cover any kind of radiation that can induce a cross-linking reaction in the toner particles after coalescence. In the invention, suitable actinic radiation includes IR-radiation, visible light, UV-light and γ-radiation. Suitable particle beams include electron beams.

At the glass transition temperature Tg of a resin, the solid resin undergoes a glass transition and change from an amorphous rigid structure to a flexible structure in which the internal molecules of the resin can move relative to each other. If the resin is continued to be heated above its glass transition temperature Tg, the resin will eventually form a disordered polymer melt. As well as having resin materials with an entirely amorphous structure, the resin material may have a semi-crystalline structure comprising amorphous portions. If the resin material comprises such a semi-crystalline material, the glass transition temperature Tg will correspond to the point at which these amorphous portions undergo the glass transition.

The invention also covers a method of fusing and curing dry core-shell toner particles according to the invention, wherein the core-shell toner particles are image-wise deposited on a substrate and fused onto the substrate, and finally the fused toner particles are cured by means of radiation.

Preferably, radiation is UV light, and the core-shell toner particles comprise one or more photo-initiators. In a preferred embodiment the fusing and curing is done in-line. The invention also covers an apparatus for forming a toner on a substrate comprising: means for supplying dry core-shell toner particles according to an embodiment of the invention, means for image-wise depositing said dry core-shell toner particles on said substrate, means for fusing said core-shell toner particles on said substrate, and means for off-line or in-line radiation curing said fused toner particles. Preferably, the substrate is fed by a web. The invention also encompasses substrates on which core-shell toner particles of embodiments of the invention are cured.

To test the melting behaviour of the toners at elevated temperatures, a melt viscosity measurement can be conducted. The melt viscosity is measured in a AR2000ex Rheometer from TA Instruments The viscosity measurement is carried out at a sample temperature of 120° C. The sample having a weight of 0.85 g is applied in the measuring gap (about 1.5 mm) between two parallel plates of 25 mm diameter one of which is oscillating about its vertical axis at 1 Hz with an amplitude of 0.005 radians. The sample is temperature equilibrated for 10 min at 120° C.

To test the quality of the fused and cured toner images on the substrate a MEK rub resistance test may be used. With a cotton path 4-4931 from AB Dick soaked with MEK (methyl ethyl ketone) the fused and cured toner images are rubbed with a pressure between 100 and 300 g/cm$^2$. One count is equal to an up and down rub. The image that is rubbed has an applied mass of 1 mg/cm$^2$ of cyan toner. The rubs are counted till the substrate becomes visible. The number of rubs is a measure for the solvent and temperature resistance of the toner images and relates to the degree of crosslinking of the resin system. In embodiments of the invention the number of rubs is preferably at least 5, more preferable 10 and even more preferable 20.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1A:
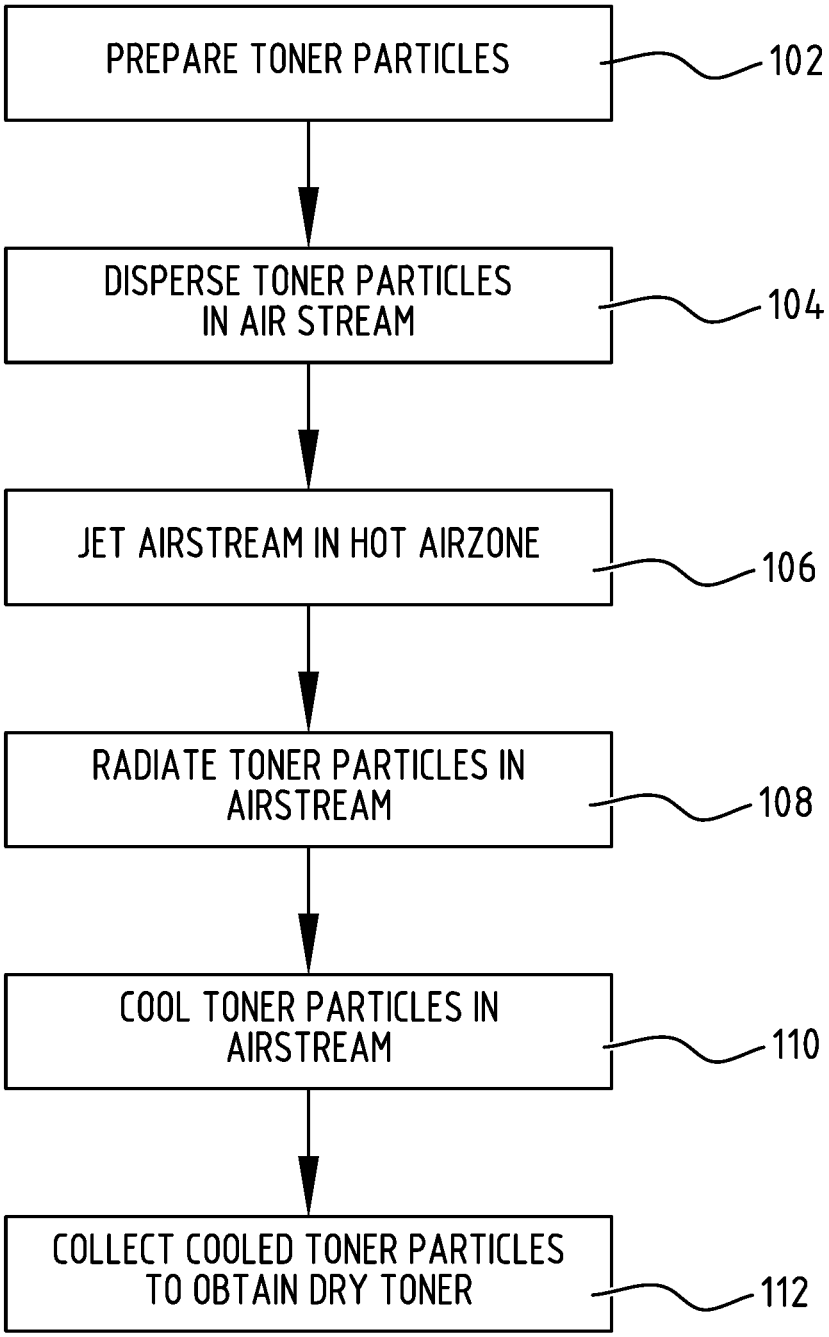
FIG. 1A illustrates schematically an exemplary embodiment of the method.

FIG. 1A illustrates an exemplary embodiment of a method for preparing a radiation curable dry toner. The method comprises the following steps.

In a first step 102 dry radiation curable toner particles comprising a radiation curable resin material having a first glass transition temperature Tg1 are prepared. Preferably, the first glass transition temperature is below 60° C., more preferably below 50° C., and most preferably between 30 and 50° C. Preferably, the prepared radiation curable toner particles have an average volume-based diameter between 5 and 20 micrometre, preferably between 5 and 15 micrometre, most preferably between 5 and 10 micrometre.

The preparation of toner particles in step 102 can use any method known in the art. For example, these toner particles can be prepared by melt kneading the toner ingredients (e.g. curable resin(s), charge control agent(s), colouring agent(s), photo-initiator(s), etc). After the melt kneading the mixture is cooled and the solidified mass is pulverized and milled and the resulting particles classified. Also other techniques to produce toners, e.g. floculation techniques and techniques to produce so called chemically produced toners, prepared via "emulsion polymerisation" and "polymer emulsion", can be used with this invention. Yet another technique that can be used consists in dissolving the resins into an organic solvent, mixing these with colouring agents and/or waxes and/or charge controlling agents, diluting the result through the addition of water and surfactants and creating in such a way round shaped UV curable toners.

In step 102, the toner particles are preferably prepared according to the following method: a step of sufficiently mixing one or more radiation curable resins, a colouring agent, an optional photo-initiator, an optional filler, an optional releasing agent, and any other optional components, in a mixer such as, but not limited to, a Henschel Mixer or a ball mill; a step of melting, kneading, and milling the mixture by using a heat kneading machine such as a kneader or an extruder; a step of finely pulverizing the melted kneaded product after cooling the melted kneaded product to obtain finely pulverized particles; and optionally adding additives and perform a step of surface or shape modification, and optionally add additives for a second time. The latter step may be performed by mechanical or chemical means or via a dedicated temperature treatment. Optionally, the adding of additives and the performing of a surface or shape modification may be performed during step 104 and/or step 106 and/or step 108, see further. The step of mixing, kneading, and pulverizing described above is not a particular limiting step of the invention, and can be performed under normal conditions with a known apparatus.

In a second step 104, the prepared toner particles of step 102 are dispersed in an air flow to create separated toner particles.

In a third step 106 the airstream with dispersed toner particles is brought into a hot air zone, in order to melt at least an outer shell of the toner particles. By adjusting the air temperature and residence time an outer shell with a desired thickness can be brought at a desired temperature above Tg1. Also the heating of the outer shell in the air stream will adjust the shape of the toner particles, and will in particular smoothen the outer surface. Steps 104 and 106 may be performed in a hot air treatment device with a hot air zone in which the temperature is e.g. between 160-215° C., and with a configuration such that the residence time of the toner particles is 10 to 50 milliseconds. Preferably the heating is performed such that an outer shell having an average thickness below 500 nanometre, preferably between 20 and 400 nanometre, more preferably between 40 and 350 nanometre, and most preferably between 50 and 300 nanometre, is in a molten state. Such thickness will result in a good storage stability of preferably at least 90%, more preferably at least 95%, wherein the storage stability is determined as specified above.

In a following step 108 an outer shell of the toner particles in the air stream is cured by radiation, typically UV light if a UV curable toner is being prepared, whilst the outer shell is at a temperature above the first glass transition temperature Tg1 as a consequence of the passage through the hot air zone in step 106. For example, there may be provided a curing zone downstream of the hot air zone, and there may be provided a UV radiating source for radiating said curing zone. In exemplary embodiments different types of UV lamps or UV LEDs can be used, and the choice of the type of UV lamp or UV LED that will be used, will depend typically on the toner formulation and on the type of photo-initiator that is used. A proper match between the emission spectrum of the UV lamp or LED and the absorption spectra of the used photo-initiator is recommended to obtain an efficient curing of the outer shell. Preferably, the UV source has a UV power between 20 W/cm and 250 W/cm in order that the UV curing is done with at most 30 $J/cm^2$.

In a further step 110 the toner particles are cooled, e.g. by cooling down the toner air mixture and removal of the excess of air with a cyclone. In step 112 the collected toner particles are collected in order to obtain dry radiation curable toner.

Adjusting the toner composition can be done e.g. by the choice of the radiation curable resin material and, when UV light is used as the radiation, the type and concentration of the photo-initiator. The curing of the radiation curable resin material can be improved by increasing the concentration of photo-initiator. However, in prior art embodiments, this increase will have some drawbacks: depending on the type of photo-initiator a drop in the glass transition temperature may be observed. In prior art embodiments this drop of the glass transition temperature results in a bad storage stability and an increased formation of agglomerates during development. In an embodiment of the invention, by providing the toner particles with a cured outer shell, this drawback is at least partially overcome, since the outer shell will have a higher glass transition temperature so that the toner will not suffer from a bad storage stability and increased formation of agglomerates during development, whilst the inner portion of the toner particles can have a low glass transition temperature. In exemplary embodiments, a photo-initiator concentration between 0.5 and 6 weight % of the total amount of toner ingredients may be used. The type of photo-initiator can also be that it—or its fragments after decomposition—becomes a part of the crosslinked resin system to reduce the tendency for migration from the crosslinked image afterwards.

In an alternative embodiment where the preparing of the toner particles comprises including a thermal initiator in at least an outer shell of the toner particles, step 108 may be omitted. Step 106 may then consist in curing the outer shell of the toner particles by heating the toner particles such that the outer shell of the toner particles melts and the thermal initiator in the outer shell decomposes to cause the curing of the outer shell in the time between heating and cooling.

Figure 1B:
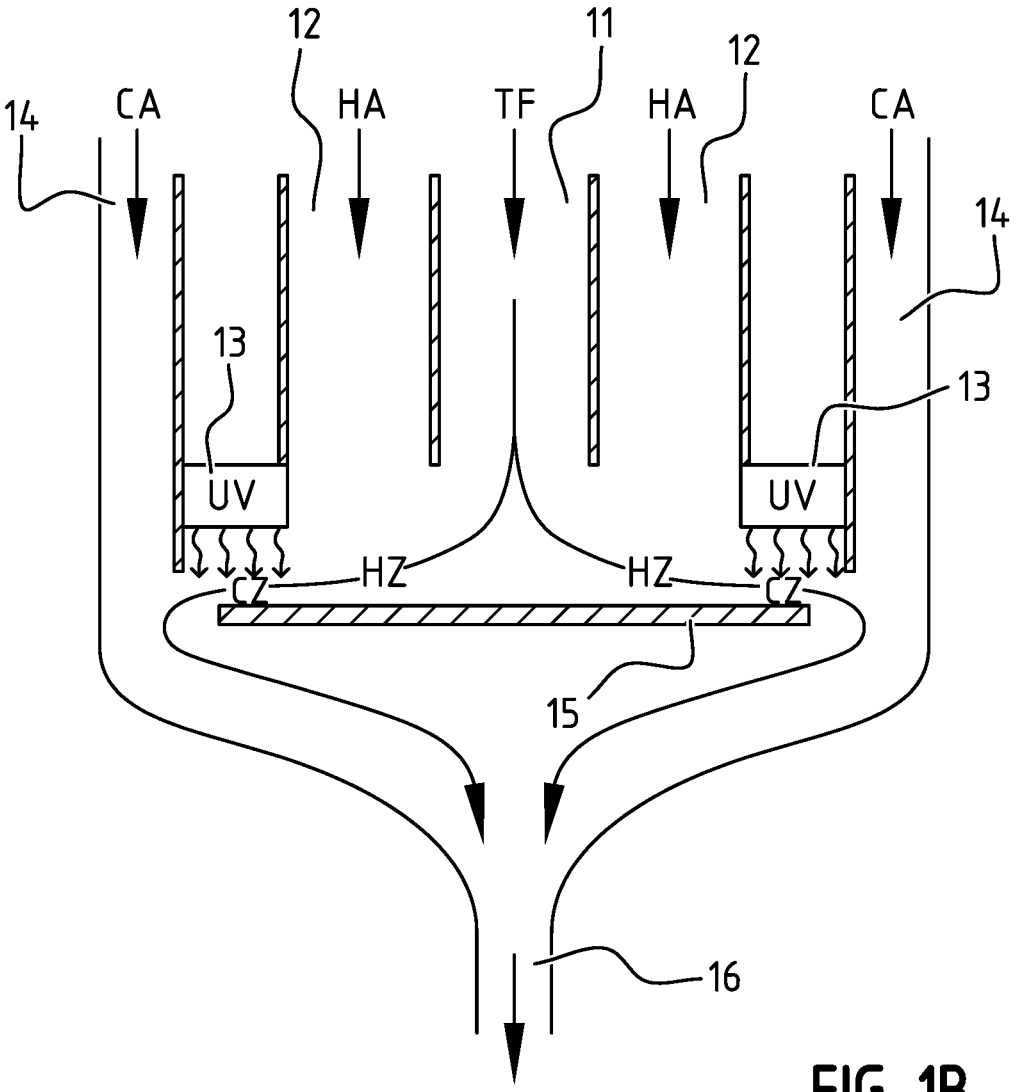
FIG. 1B illustrates a possible configuration for performing the method of FIG. 1A.

FIG. 1B illustrates an embodiment of a hot air treatment device for use in the method of FIG. 1A. The hot treatment device comprises a central passage 11 through which toner particles TF are fed. In this stream the toner particles are separated from each other so that they all flow in an isolated state. The central passage 11 is surrounded by a surrounding passage 12 for a hot airstream HA. The toner particles RF are brought in the hot airstream HA and the flow is guided by a plate 15 below central passage 11 and surrounding passage 12, so that a hot air zone HZ is created above the plate 15. The hot treatment device further comprises a UV source 13 for submitting the flow to UV light in order to cure an outer shell of the toner particles in a curing zone CZ. Further there is provided a passage 14 surrounding the hot air passage 12, for a cold air stream CA. The cold airstream CA is used to cool the flow downstream of the curing zone CZ. Finally the cooled core-shell toner particles leave the device through an outlet 16 where they are recuperated.

Figure 2:
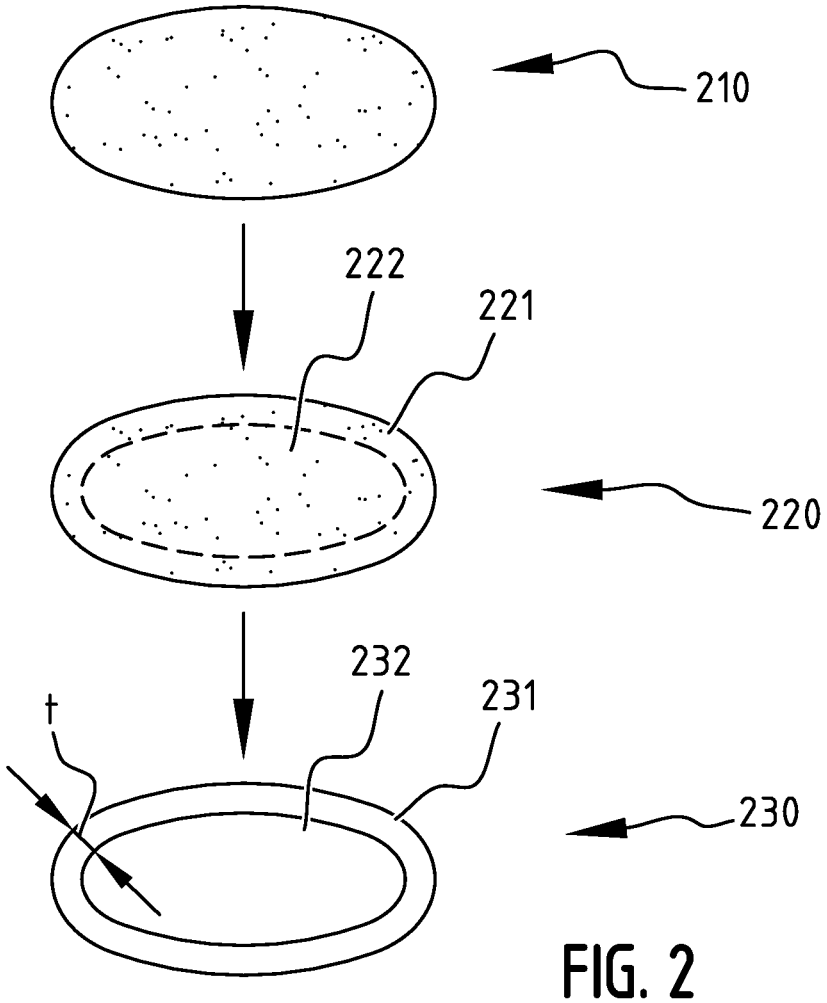
FIG. 2 illustrates schematically a first exemplary embodiment of a toner particle during consecutive steps of an embodiment of the method.

FIG. 2 illustrates an example of a toner particle during consecutive steps of the method. In step 104 the prepared toner particle may be a toner particle 210 comprising UV curable resin material with a photo-initiator 211 distributed across the volume of the toner particle 210. In step 106 an outer shell 221 of the toner particle 220 is brought at a temperature above the first glass transition temperature Tg1 of the UV curable resin material, whilst an inner portion 222 remains at a lower temperature. After steps 108 and 110 a toner particle 230 is obtained with an outer shell 231 with cured resin material having a second glass transition temperature Tg2 and an uncured inner portion 232. The second glass transition temperature Tg2 of the cured resin material in the outer shell 231 is higher than the first glass transition temperature Tg1 of the uncured resin material in the inner portion 232.

Figure 3:
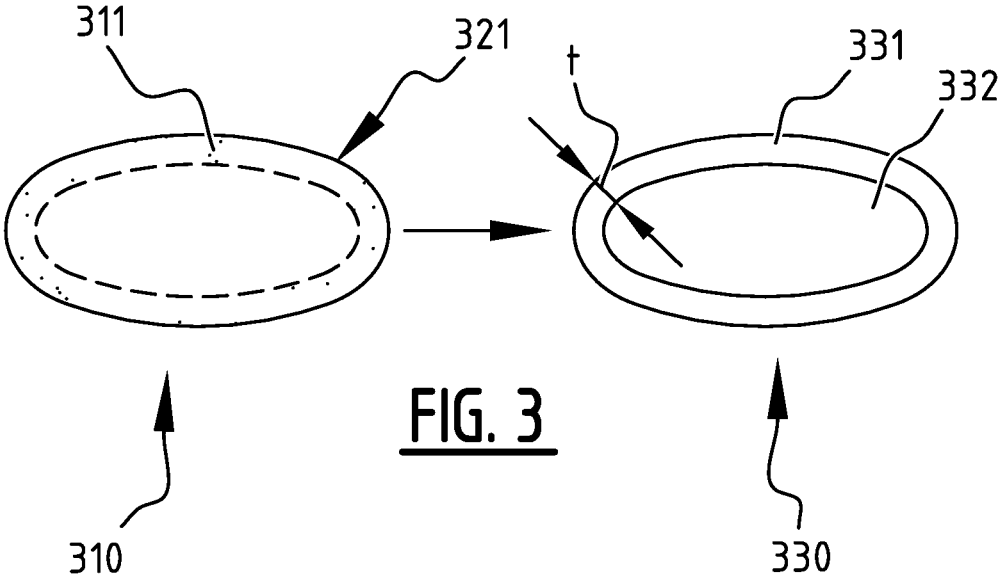
FIG. 3 illustrates schematically a second exemplary embodiment of a toner particle during consecutive steps of an embodiment of the method.

FIG. 3 illustrates another example of a toner particle during consecutive steps of the method. In step 104 the prepared toner particle 310 comprises UV curable resin material with a thermal initiator 311 arranged in an outer shell 321 of the toner particle 310. In step 106 at least the outer shell 321 of the toner particle 310 is brought at a temperature above the first glass transition temperature Tg1 of the UV curable resin material, causing the curing of the outer shell 321. As explained above, in such an embodiment with a thermal initiator, the radiating step 108 may be omitted. After step 110 a core-shell toner particle 330 is obtained with a cured outer shell 331 with cured resin material having a second glass transition temperature Tg2, and an uncured inner portion 332. The second glass transition temperature Tg2 of the cured resin material in the outer shell 331 is higher than the first glass transition temperature Tg1 of the uncured resin material in the inner portion 332.

Preferably the first glass transition temperature Tg1 is below 60° C., preferably below 50° C., and more preferably between 30 and 50° C. Preferably, the difference between the second glass transition temperature Tg2 and the first glass transition temperature Tg1 is smaller than 25° C., more preferably smaller than 23° C., most preferably smaller than 20° C. Preferably the outer shell 231, 331 has an average thickness t below 500 nanometre, more preferably between 20 and 400 nanometre, most preferably between 40 and 350 nanometre, and e.g. between 50 and 300 nanometre.

Toner particles, useful in embodiments of the invention, can comprise any normal toner ingredients e.g. a radiation curable resin material composed of one or more radiation curable resins, one or more photo-initiators, one or more charge control agents and charge levelling agents, a colouring agent (colour or black or white), an inorganic filler, an anti-slip agent, a flowing agent, a wax, etc.

The radiation curable resin material is composed of one or more radiation curable resins. The radiation curable resin material is preferably a UV-light curable resin material, but may also be another radiation curable resin material, e.g. an electron-beam curable resin material. The radiation curable resin material may be a mixture of one or more radiation curable resins. Further the radiation curable resin material may be mixed with a non-radiation curable resin material comprising one or more non-radiation curable resins. In that case, the weight percent of radiation curable resin material with respect to the total amount of resin material (i.e. the sum of the radiation curable resin material and non-radiation curable resin material) is preferably higher than 90 weight %, more preferably higher than 95 weight %, and most preferably more than 98 weight %. The radiation curable resin material is preferably curable by UV-light. Useful UV curable resins are resins based on (meth)acryloyl containing polyester. The term polyester includes all polymers with a backbone structure based on a polycondensation of an alcohol, preferably one or more polyols having 2 to 5 hydroxyl groups, and a carboxylic acid-containing compound. Examples of such UV curable resins are unsaturated polyesters based on terephthalic and/or isophthalic acid as the carboxylic acid-containing component, and on neopentylglycol and/or trimethylolpropane as the polyol component and whereon afterwards an epoxy-acrylate such as glycidyl (meth)acrylate may be attached. Another UV curable resin is a polyester-urethane acrylate polymer which may be obtained by the reaction of a hydroxyl-containing polyester, a polyisocyanate and a hydroxy-acrylate. Another useful curable resin material is composed of a mixture of an unsaturated polyester resin in which maleic acid or fumaric acid is incorporated and a polyurethane containing a vinyl ether. Other useful radiation curable polymeric resins are UV curable solid epoxy resins with a glass transition temperature which is higher than 40° C. as disclosed in EP 667 381 B1, which is included herein by reference. If a non-radiation curable resin material is included, the weight percentage of the non-radiation curable resin material is preferably less than 5 weight % of the total resin amount. The non-radiation curable resin material may contain one or more of the following resins: poly condensation polymers (e.g. polyesters, polyamides, co(polyester/polyamides), etc), epoxy resins, addition polymers. Commercially available curable resins are sold under the tradename Uvecoat (sold by Allnex) and Uracross (sold by DSM).

Useful photo-initiators in the context of this invention include, but are not limited to, compounds such as shown in the formulae I, II and III of EP 2 019 340 in the name of the Applicant, or mixtures of these compounds. EP 2 019 340 is included herein by reference. The photo-initiator is preferably incorporated in the toner particles together with the UV curable resin in a concentration range of preferably 0.5-6% by weight with respect to the total weight of the toner particle.

In order to reduce the fusing energy a low viscosity toner resin in the inner portion is desirable. This can be achieved by incorporation of UV curable or non-curable crystalline polymers in the prepared toner particles. Such polymers will have a rather high viscosity at room temperature but have a low viscosity at the fusing temperature. Those polymers however have also the tendency to reduce the glass transition temperature. In embodiments of the invention, such polymer materials may be useful since the drawbacks of having a low glass transition temperature are overcome by providing the particles with a cured outer shell.

In exemplary embodiments an additional photo-initiator and/or thermal initiator may be added in the outer shell of the toner particles, e.g. together with any flow additives. A suitable additional photo-initiator is one or more of the photo-initiators mentioned above or any one or more of the following photo-initiators: benzophenone and substituted benzophenones, 1-hydroxycyclohexyl phenyl ketone, thioxanthones such as isopropylthioxanthone, 2-hydroxy-2-methyl-1-phenylpropan-1-one, 2-benzyl-2-dimethylamino-(4-morpholinophenyl) butan-1-one, benzil dimethylketal, bis (2,6-dimethylbenzoyl)-2,4,4-trimethylpentylphosphine oxide, 2,4,6-trimethylbenzoyldiphenylphosphine oxide, 2,4,6-trimethoxybenzoyldiphenylphosphine oxide, 2-methyl-1-[4-(methylthio)phenyl]-2-morpholinopropan-1-one, 2,2-dimethoxy-1,2-diphenylethan-1-one or 5,7-diiodo-3-butoxy-6-fluorone, Irgacure™ 184, Irgacure™ 500, Irgacure™ 369, Irgacure™ 1700, Irgacure™ 651, Irgacure™ 819, Irgacure™ 1000, Irgacure™ 1300, Irgacure™ 1870, Darocur™ 1173, Darocur™ 2959, Darocur™ 4265 and Darocur™ ITX available from Ciba Specialty Chemicals, Lucerin™ TPO-available from BASF, Esacure™ KT046, Esacure™ KIP150, Esacure™ KT37 and Esacure™ EDB available from Lamberti, H-Nu™ 470 and H-Nu™ 470X available from Spectra Group. Suitable thermal initiators are: inorganic or organic peroxides, including potassium peroxide sulfate, organic hydroperoxides, benzoyl peroxide, lauryl peroxide, 1-1-(t-butylperoxy)-3,3,5-trimethylcyclohexane, n-butyl-4,4-di-(t-butylperoxy)valerate, dicumyl peroxide, dibenzoyl peroxide, di-(n-propyl) peroxydicarbonate, t-butyl benzoate, t-amyl(2-ethylhexyl)monoperoxydicarbonate, 2,2-di-(t-butyl-peroxy)butane, dicumyl peroxide, 2,5-dimethyl-2,5-di(t-butylperoxy)-hexane, 1,3-bis(t-butylperoxyisopropyl)benzene, 1,3-bis(cumylperoxyisopropyl)benzene, 2,4-dichlorobenzoyl peroxide, caprylyl peroxide, lauroyl peroxide, t-butyl peroxyisobutyrate, p-chlorobenzoyl peroxide, hydroxyheptyl peroxide, di-t-butyl diperphthalate, 1,1-di(t-butylperoxy)-3,3,5-trimethylcyclohexane, di-t-butyl peroxide, benzoyl peroxides, lauryl peroxide, n-butyl-4,4-di-(t-butylperoxy)valerate, hydrogen peroxide, acetyl peroxide, cumyl peroxide, tert-butyl peroxide, propyonyl peroxide, chlorobenzoyl peroxide, dichlorobenzoyl peroxide, bromomethylbenzoyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl phenylperacetate, tert-butyl methoxyperaceate and tert-butyl N-(3-toluyl)percarbamate; azo and diazo compounds, including 2,2'-azobispropane, 2,2'-dichloro-2,2'-azobispropane, 1,1'-azo (methylethyl) diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutylonitrile, methyl 2,2'-azobis-2-methylpropionate, 2,2'-dichloro-2,2'-azobisbutane, 2,2'-azobis-2-methylbutylonitrile, dimethyl 2,2'-azobisisobutylate, 1,1'-azobis(sodium 1-methylbutylonitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalononitrile, 2,2'-azobis-2-methylvaleronitrile, dimethyl 4,4'-azobis-4-cyanovalarate, 2,2'-azobis-2,4-dimethylvaleronitrile, 1,1'-azobiscyclohexanenitrile, 2,2'-azobis-2-propylbutylonitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4-azobis-4-cyanopentanoate), poly(tetraethylene glycol-2,2'-azobisisobutylate), azoisobutyronitrile, azodimethylvaleronitrile, diazoamineazobenzene 2,2'-azodimethylvaleronitrile, 2,2'-azoisobutyronitrile, azobiscyclohexanenitrile, 2-methylbutyronitrile, 2-t-butylazo-2-cyanopropane; 2,2'-azobis(2,4-dimethyl-4-methoxyvaleronitrile), 2,2'-azobis(isobutyronitrile), 2,2'-azobis(2,4-dimethylvaleronitrile), 1,1'-azobis(cyclohexanecarbonitrile) and substituted or unsubstituted pinacols, including benzopinacol, 4,4'-dichlorobenzopinacol, 4,4'-dibromobenzopinacol, 4,4'-diiodobenzopinacol, 4,4',4",4'"-tetrachlorobenzopinacol, 2,2',4,4'-tetrachlorobenzopinacol, 4,4'-dimethylbenzopinacol, 3,3'-dimethylbenzopinacol, 2,2'-dimethylbenzopinacol, 3,3',4,4'-tetramethylbenzopinacol, 4,4'-dimethoxybenzopinacol, 4,4',4",4'"-tetramethoxybenzopinacol, 4,4'-diphenylbenzopinacol, 4,4'-dichloro-4",4'"-dimethylbenzopinacol, 4,4'-dimethyl-4",4'"-diphenylbenzopinacol, xanthonpinacol fluorenonepinacol, acetophenonepinacol, 4,4'-dimethylacetophenone-pinacol, 4,4'-dichloroacetophenonepinacol, 1,1,2-triphenyl-propane-1,2-diol, 1,2,3,4-tetraphenyl butane-2,3-diol, 1,2-diphenyl-cyclobutane-1,2-diol, propiophenone-pinacol, 4,4'-dimethylpropiophenonepinacol, 2,2'-diethyl-3,3'-dimethoxypropiophenone-pinacol, 1,1,1,4,4,4-hexafluoro-2,3-diphenyl-butane-2,3-diol, benzopinacol-mono methylether, benzopinacol-mono-phenylether, benzopinacol and monoisopropyl ether, benzopinacol monoisobutyl ether, benzopinacol mono(diethoxy methyl) ether.

Positive and negative charge control agents can be used in order to modify or improve the triboelectric chargeability in either negative or positive direction. Useful charge control agents for providing a net positive charge to the toner particles are nigrosine compounds and quaternary ammonium salts. Charge control agents for yielding negative chargeable toners are metal complexes of salicylate, and organic salts of an inorganic polyanion. Some CCA's can interfere with the crosslinking reaction, they have to be chosen in such way based on their composition and eventually located there where they do interfere in a minimal way.

The colouring agents may contain organic dyes/pigments of for example the group of phtalocyanine dyes, quinacidrone dyes, triaryl methane dyes, sulphur dyes, acridine dyes, azo dyes and fluoresceine dyes. Also $TiO_2$ or $BaSO_4$ can be used as a pigment to produce white toners.

A description of charge control agents, colouring agents and other additives useful in toner particles, to be used in a toner composition according to the present invention, can be found in e.g. EP 601235 B1, which is included herein by reference.

When the toner particles are intended for use in colour imaging, it is preferred that the average volume-based diameter is between 4 and 12 micrometre, most preferred between 5 and 10 micrometre, and e.g. between 6 and 8 micrometre. The particle size distribution of the toner particles can be of any type. It is however preferred to have an essentially Gaussian or normal particle size distribution, either by number or volume, with a coefficient of variability (standard deviation divided by the average) smaller than 0.5.

Exemplary embodiments also relate to a dry electrostatic developer comprising a radiation curable dry toner prepared according to the method of any one of the embodiments above or a radiation curable dry toner of any one of the embodiments above. This is preferably a multi-component developer wherein both magnetic carrier particles and toner particles are present or in a trickle type development where both toner and carrier are added to the developer system with simultaneous removal of a part of the developer mixture. The toner particles can be negatively charged as well as positively charged. Carrier particles can be either magnetic or non-magnetic. Preferably, the carrier particles are magnetic particles. Suitable magnetic carrier particles have a core of, for example, iron, steel, nickel, magnetite, $\gamma$-$Fe_2O_3$, or certain ferrites such as for example CuZn and environmental friendly ferrites with Mn, MnMg, MnMgSr, LiMgCa and MnMgSn. These particles can be of various shapes, for example, irregular or regular shape. Generally these carrier particles have a median particle size between 30 and 65 μm. Exemplary non-magnetic carrier particles include glass, non-magnetic metal, polymer and ceramic material. Non-magnetic and magnetic carrier particles can have similar particle size. Preferably the carrier core particles are coated or surface treated with diverse organic or inorganic materials or resins in a concentration of 0.4 to 2.5% to obtain, for example, desirable electrical, tribo electrical and/or mechanical properties. In the two-component developer the amount of UV curable toner particles can be, for example, between about 1 and about 12 weight % (relative to the amount of developer). The distribution of charge/diameter (Q/D) of the toner particles is preferably in the range from an absolute value of 3 to 13 fC/10 μm as measured with a Q/D meter from Dr R Epping PES Laboratorium 8056 Neufahrn.

The toner according to exemplary embodiments described above can be used for printing on any suitable substrate. For example it can be paper, board, plastic and/or metal foils, thermal paper, and combinations thereof in different thicknesses. Examples of metal foils as substrates are foils from iron, steel, and copper and preferentially from aluminium and its alloys. Suitable plastics are e.g. polyvinyl chloride (PVC), polyvinylidene chloride (PVDC), polyester, polycarbonates, polyvinyl acetate, polyolefins and particularly polyethylenes (PE), like polyethylene of high density (HDPE), polyethylene of middle density (MDPE), linear polyethylene-middle density (LMDPE), polyethylene low-density (LDPE), linear low density polyethylene (LLDPE), and (biaxially oriented) polypropylene (PP). The thickness of the substrates can range from e.g. of 5 until 1000 micrometre, preferably 15 until 200 micrometre. The substrate can be fed by means of a web, or by means of sheets.

The invention also covers a method of fusing and curing dry core-shell toner particles according to the invention, wherein the core-shell toner particles are image-wise deposited on a substrate and fused onto the substrate, and the fused core-shell toner particles are cured. The curing may be e.g. UV curing or electron beam (EB) curing. Preferably, radiation is UV light, and the toner particles comprise one or more photo-initiators. The fusing may be contact fusing or non-contact fusing, wherein the latter is preferred. The fusing and curing may be done in-line and immediately after each other so that the temperature applied at the moment of the fusing is still high enough at the moment of crosslinking. The invention also covers an apparatus for forming a toner on a substrate comprising: means for supplying dry toner according to an embodiment of the invention, means for image-wise depositing said dry toner on said substrate, means for fusing core-shell toner particles of said dry toner on said substrate, and means for off-line or in-line curing said fused core-shell toner particles. Preferably, the substrate is fed by a web.

In an apparatus according to the present invention it is preferred to use core-shell toner particles comprising a UV-curable resin and thus the means for radiation curing the core-shell toner particles comprise are means for UV-curing (UV-light emitters as e.g. UV lamps or UV LEDs). The fusing of said toner images can be performed by non contact fusing, e.g. by infrared radiation (using infra-red radiators), or by contact fusing, e.g. hot roller fusing, or by a combination of non-contact and contact fusing. The means for UV curing may be installed immediately after the fusing means so that the UV curing proceeds on the still molten toner image. Different types of UV lamps or LEDs can be used and the choice of the type will depend on the toner formulation and on the type of photo-initiator that is used. A proper match between the emission spectrum of the UV source and the absorption spectra of the used photo-initiator is recommended to obtain an efficient curing. A combination of infra-red radiators (the means for fusing the core-shell toner particles) and UV sources (the means for radiation curing) in a single station (a fixing/curing station), so that the fusing and the radiation curing proceed simultaneously, is also a possible design feature of an apparatus according to this invention. The apparatus according to the present invention can comprise if so desired, more than one fixing/curing station. The UV emitting means are preferably UV radiators, e.g. UV lamps or UV LEDs, with a UV power between 20 W/cm and 250 W/cm in order that the UV curing is done with at most 30 J/cm$^2$. In yet other embodiment the fixing/curing station is configured to emit particle beams, and in particular electron beams on the printed image in order to cure the image.

Exemplary embodiments of the toner of the invention may be used in an electrostatographic single-pass multiple station printer, e.g. a colour printer comprising image printing stations for each of a sequence of three or more primary colours such as yellow, magenta, cyan as well as other printing stations, e.g. for black toner images or for spot colour toner images.

Whilst the principles of the invention have been set out above in connection with specific embodiments and examples, it is to be understood that this description is merely made by way of example and not as a limitation of the scope of protection which is determined by the appended claims.

The invention claimed is:

1. A radiation curable dry toner comprising core-shell toner particles, wherein the core-shell toner particles have an average volume-based diameter between 5 and 10 micrometre, wherein a core-shell toner particle thereof comprises:

a. an inner portion comprising a radiation curable first resin material consisting of at least 90 weight % of the total amount of resin material of the inner portion;

b. an outer shell surrounding said inner portion, said outer shell comprising a second resin material, said second resin material being any one of the following:
cured first resin material.

2. The radiation curable dry toner of claim 1, wherein the resin material of the inner portion and of the outer shell is chosen such that the dry toner has a melt viscosity of less than 1000 Pa·s at 120° C., measured at a frequency of 1 Hz and an amplitude of 0.005 radians.

3. The radiation curable dry toner of claim 1, wherein the dry toner has a storage stability of at maximum 100 g/kg; wherein the storage stability is determined by shaking 20 g of the dry toner in a 50 ml bottle, followed by conditioning the dry toner for 40 hours at 40° C., whereupon the dry toner is manually sieved over a 300 μm sieve and the amount of toner remaining on the sieve is weighed and expressed as g/kg toner versus the original amount of 20 g.

4. The radiation curable dry toner of claim 1, wherein the first resin material has a first glass transition temperature, and the second resin material has a second glass transition temperature, and wherein the difference between the second glass transition temperature and the first glass transition temperature is smaller than 25° C. and larger than 5° C.

5. The radiation curable dry toner of claim 1, wherein the first glass transition temperature is between 20 and 60° C.

6. The radiation curable dry toner of claim 1, wherein the outer shell has an average thickness below 500 nanometre.

7. The radiation curable dry toner of claim 1, wherein the radiation curable first resin material has a milli-equivalent amount of double bounds per gram of said radiation curable resin material which is more than 0.5 meq/g.

8. The radiation curable dry toner of claim 1, wherein the radiation curable first resin material comprises a photo-initiator.

9. The radiation curable dry toner of claim 1, wherein the radiation curable first resin material is composed of any one or more of the following radiation curable resins: a resin based on (meth)acryloyl containing polyester, a polyester-urethane acrylate polymer, a mixture of an unsaturated polyester resin in which maleic acid or fumaric acid is incorporated and a polyurethane containing a vinyl ether.

10. A dry electrostatic developer comprising carrier particles and a radiation curable dry toner of claim 1.

11. A radiation curable dry toner comprising core-shell toner particles, wherein the core-shell toner particles have an average volume-based diameter between 5 and 10 micrometre, wherein a core-shell toner particle thereof comprises:

a. an inner portion comprising a radiation curable first resin material consisting of at least 90 weight % of the total amount of resin material of the inner portion;

b. an outer shell surrounding said inner portion, said outer shell comprising a second resin material which is different from the first resin material, wherein the first resin material has a first glass transition temperature and the second resin material has a second glass transition temperature, wherein the difference between the second glass transition temperature and the first glass transition temperature is larger than 5° C.

12. The radiation curable dry toner of claim 11, wherein the second resin material is a non-radiation curable resin material.

13. A method for preparing a radiation curable dry toner comprising core-shell toner particles, said method comprising:

a. preparing dry toner particles comprising a radiation curable resin material; said radiation curable resin material consisting of at least 90 weight % of the total amount of resin material of the prepared particles;

b. dispersing and heating said toner particles in an airflow;

c. curing an outer shell of said toner particles in said airflow;

d. cooling said toner particles in order to obtain the core-shell toner particles;

wherein the dry toner particles are prepared with dimensions which are such that the obtained core-shell toner particles have an average volume-based diameter between 5 and 10 micrometre.

14. The method of claim 13, wherein the preparing of the dry toner particles in step (a) comprises including a thermal initiator in at least the outer shell of the toner particles; and wherein said curing comprises heating the dispersed toner particles in the airflow such that the thermal initiator in the outer shell decomposes to cause the curing of the outer shell.

15. The method of claim 13, wherein the preparing of the dry toner particles in step (a) comprises including a photo-initiator in at least an outer shell of the toner particles; and wherein said curing comprises heating and irradiating the dispersed toner particles in the airflow with actinic radiation such that the photo-initiator in the outer shell decomposes to cause the curing of the outer shell.

16. The method of claim 13, wherein the preparing of the dry toner particles in step (a) comprises:

a. melt kneading ingredients comprising a colouring agent and radiation curable compounds to obtain a mixture;

b. cooling said mixture;

c. milling said cooled mixture to obtain dry toner particles.

17. The method of claim 13, wherein the radiation curable resin material has a glass transition temperature between 20 and 60° C.

18. The method of claim 13, wherein the curing is controlled such that the outer shell has an average thickness below 500 nanometre.

19. A method for preparing a radiation curable dry toner comprising core-shell toner particles, said method comprising:

a. preparing an emulsion including particles comprising a radiation curable first resin material; said radiation curable first resin material consisting of at least 90 weight % of the total amount of resin material of the prepared particles;

b. aggregating said particles to form aggregated particles;

c. contacting said aggregated particles with a second resin material to form an outer shell over said aggregated particles; said second resin material being a resin material which is different from the first resin material, wherein the first resin material has a first glass transition temperature and the second resin material has a second glass transition temperature, wherein the difference between the second glass transition temperature and the first glass transition temperature is larger than 5° C.;

d. coalescing the aggregated particles with the outer shell to form core-shell toner particles;

wherein said steps are performed such that the formed core-shell toner particles have an average volume-based diameter between 5 and 10 micrometre.

20. The method of claim 19, wherein the first resin material has a melt viscosity of less than 1000 Pa·s at 120° C., measured at a frequency of 1 Hz and an amplitude of 0.005 radians.

21. The method of claim 19, wherein the first and second resin material are chosen such that the difference between the second glass transition temperature and the first glass transition temperature is smaller than 25° C.

* * * * *